United States Patent [19]

DiMatteo

[11] 4,180,930

[45] Jan. 1, 1980

[54] REFLECTED THREE DIMENSIONAL DISPLAY

[75] Inventor: Paul DiMatteo, Melville, N.Y.

[73] Assignee: Solid Photography Inc., Melville, N.Y.

[21] Appl. No.: 825,952

[22] Filed: Aug. 19, 1977

[51] Int. Cl.[2] ..... G09F 1/12

[52] U.S. Cl. ..... 40/160; 40/10 D

[58] Field of Search ..... 40/160, 28 B, 516; 272/8 M; 428/13

[56] References Cited

U.S. PATENT DOCUMENTS

| | | | |
|---|---|---|---|
| 1,140,148 | 5/1915 | Furber | 272/8 M X |
| 2,261,578 | 11/1941 | Bauer | 428/323 X |
| 2,511,552 | 6/1950 | Stumpges | 428/13 |
| 2,521,558 | 9/1950 | Alvarez | 40/152 |
| 3,312,197 | 4/1967 | Smith | 428/13 |
| 3,910,408 | 10/1975 | Husney | 40/28 B |
| 3,919,797 | 11/1975 | Murakami | 40/126 R |
| 4,014,122 | 3/1977 | Woods | 428/13 |

*Primary Examiner*—Louis G. Mancene
*Assistant Examiner*—Wenceslao J. Contreras
*Attorney, Agent, or Firm*—Max Fogiel

[57] ABSTRACT

Half of two symmetrical portions of an object to be displayed, is cut or embedded in one surface of a block of transparent material. The surface of the block in which the symmetrical half of the object is cut or embedded, is made reflective, so that a person viewing the block of transparent material sees the cut or embedded half together with reflections of that half to obtain a view of the composite halves of the symmetrical object. The arrangement is such that when the profile part of a human portrait is cut or embedded in the block, a viewer will see the entire head of the portrait, and not only the profile part. The reflections providing the image of the other symmetrical half of the portrait which is not cut or embedded in the block.

8 Claims, 4 Drawing Figures

REFLECTED THREE DIMENSIONAL DISPLAY

BACKGROUND OF THE INVENTION

In providing display arrangements, it is often desirable to display a symmetrical three-dimensional surface such as a human portrait, for example, when using only half of the symmetrical surface. Thus, a profile view of a person's portrait may be taken with the intent of using this profile view and still obtain the visual effect of seeing the entire portrait. Use of only the profile portion or half of the symmetrical surface to be displayed, results in a more economical and simpler display arrangement.

Accordingly, it is an object of the present invention to provide a display arrangement in which only half of a symmetrical surface is used while providing the visual effect of viewing the entire symmetrical surface.

Another object of the present invention is to provide an arrangement of the foregoing character which is substantially simple in construction and may be easily applied.

A further object of the present invention is to provide an arrangement for displaying symmetrical objects, as described, which may be economically fabricated.

SUMMARY OF THE INVENTION

The objects of the present invention are achieved by providing a display arrangement in which a block of transparent material has cut or embedded in it, half of a symmetrical surface to be displayed. The surface of the block into which the symmetrical half of the surface is cut or embedded, is made reflective, so that when the transparent block is viewed, the reflections and direct viewing of the cut or embedded surface results in a combined effect to provide a visual picture of the entire symmetrical surface.

The transparent block, in accordance with the present invention, may have a partial cylindrical surface to provide, furthermore, a magnifying effect, so that the image viewed will appear larger than the surface cut or embedded in the block.

Half of the symmetrical surface may also be mounted directly on the surface of a mirror or other reflective surface to provide a combined visual effect of seeing the entire symmetrical surface when having, in fact, mounted only half of that surface on the reflective surface.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
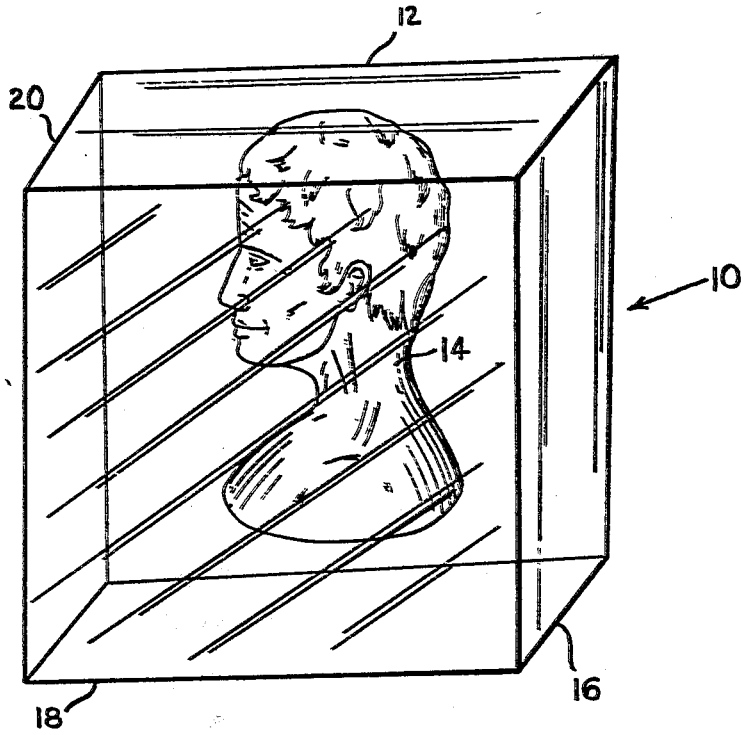
FIG. 1 is a perspective view and shows a rectangular-shaped transparent block of material having a side in which the profile of a human portrait is inserted.

Referring to FIG. 1 of the drawings, a block 10 of transparent material has a back or rear side 12 in which the profile half of a human portrait is inserted or embedded. The profile half of the bust 14 may also be cut or carved into the block 10 from the side 12. The side 12, furthermore, has a planar shape which is reflective on the internal side of the block.

When viewing the block from the outside such as from side 16 or 18, for example, a viewer will see light originating directly from the cut or embedded surface 14 simultaneously with light of the bust 14 after being reflected from the internal surface of the side 12 of the transparent block. The reflected light from the internal surface of the side 12 combines with the direct light rays originating from the bust 14 and passing through the block 10 without reflections, to provide the viewer with a visual effect of the composite bust. In this manner, the viewer obtains the effect of seeing the full face of the bust, even though there is provided within the block 10, only half of the symmetrical surface of the bust.

Depending on the direction from which the block 10 is being viewed, reflections of light from the bust or impression 14 from the end surfaces 16 and 20 may also contribute to the visual effect obtained.

The impression 14 may be cut into the block 10 by means of machining processes, or it may be produced by engraving. It may also be molded in the block. At the same time, the block may be made of transparent material in the form of glass, for example, or plastics having transparent properties.

Figure 2:
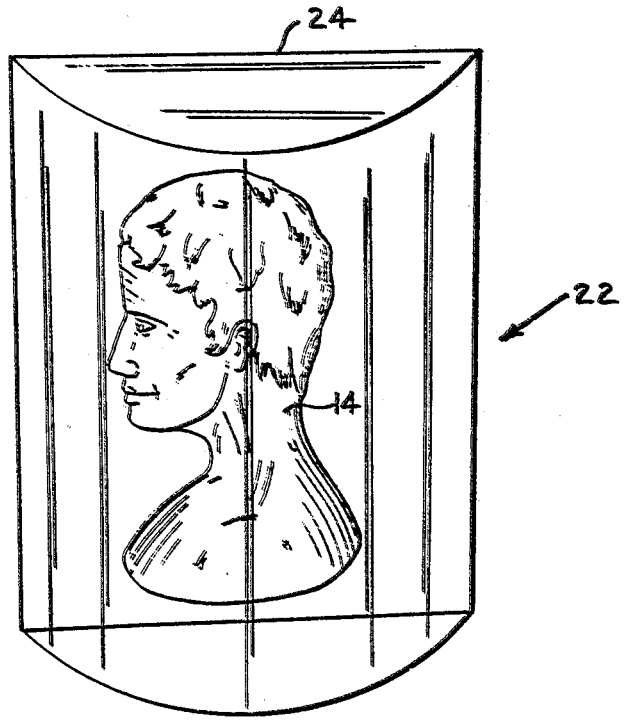
FIG. 2 is a perspective view and shows a semi-cylindrical block of transparent material having a flat side in which the profile view of a human portrait is inserted.

FIG. 2 shows the arrangement in which the impression or object 14 is inserted into a block 22 having a semi-cylindrical shape. The impression or symmetrical half of the object to be displayed, is inserted from the side 24 which has a planar shape and is reflective. When viewing the impression through the cylindrical surface of the block 22, a magnifying effect is obtained, whereby the viewer sees the impression magnified in at least one direction. By providing that the viewing surface of the transparent block is made spherical instead of cylindrical, magnification can be obtained, for example, in all directions.

Whereas the reflective surfaces 12 and 24 will reflect light as a result of the difference between the material of the block and the outer air or environment, for example, the surfaces 12 and 24 may also be silvered as in mirrors to provide for increased reflective properties, for example.

The three-dimensional viewing effect is obtained in FIG. 2 by viewing simultaneously the combination of the direct light rays originating from the impression 14 through the block 22 without reflections, and the reflected light originating from the impression 14 but being reflected from the interior surface of the side 24 before passing out through the cylindrical surface.

Figure 3:
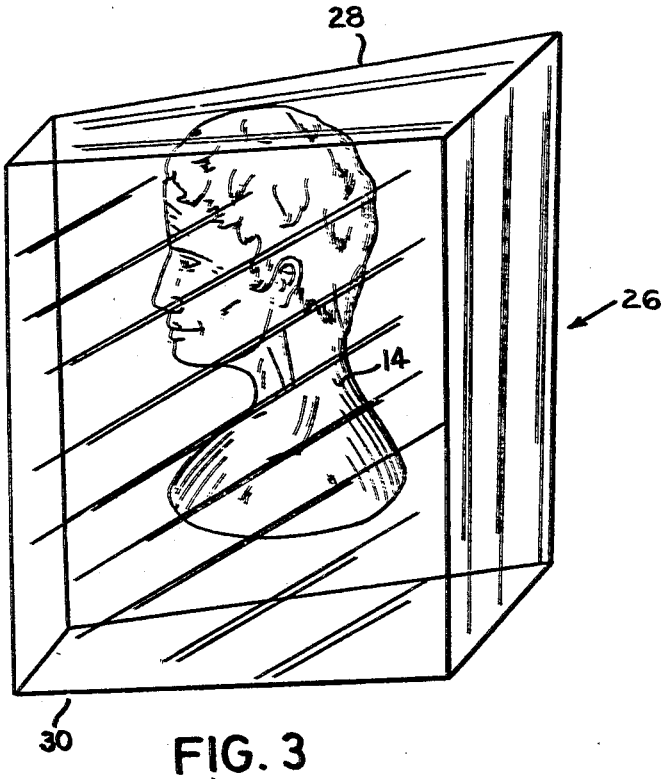
FIG. 3 is a perspective view similar to FIG. 1, and shows the arrangement in which the back side of the block holding the profile view of the human portrait, forms a substantial angle with the front side of the transparent block.

FIG. 3 shows an arrangement similar to FIG. 1, with the exception that the back side of the transparent block 26 is not parallel to the front side thereof. Thus, with the block 26, the back side 28 is angularly oriented with respect to the front side 30. With this construction, the block 26 may be viewed so that the line of sight is normal to the plane of the front side 30 while obtaining, at the same time, the visual effect of seeing the entire symmetrical surface. When the arrangement of FIG. 1 is viewed in a normal and central manner, this effect is not obtained, since the light rays reflected from the interior surface of the side 12 cannot be seen. Such reflected light rays from the interior surface of the side 12 form an angle with that reflective surface, and therefore the viewer must also be angularly disposed with respect to this reflective surface. When viewing the arrangement of FIG. 1 in a normal and central manner, only the light rays originating directly from the impression 14 are seen. Those light rays originating from the impression 14 and reflected by the internal surface of the side 12 will not be seen, and therefore the composite picture is not obtained. With the arrangement of FIG. 3, however, the inclination of the side 28 with respect to the side 30 permits the viewer to view the impression 14 normally and centrally with respect to the side 30 and still obtain the composite effect of seeing the three-dimensional surface of the entire impression or bust 14, and not just the profile thereof.

Figure 4:
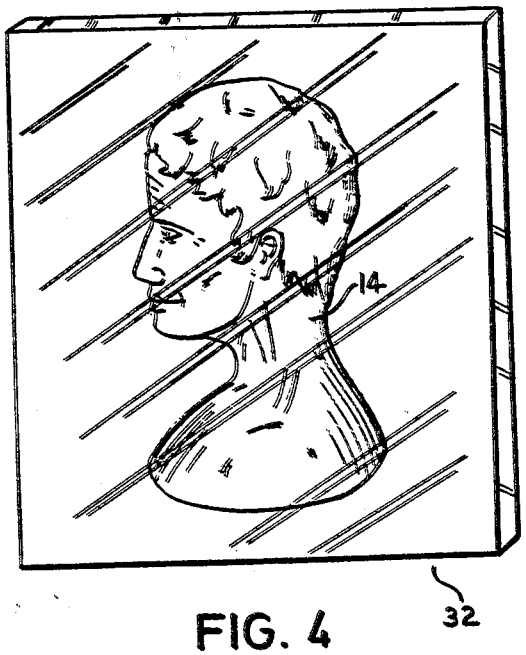
FIG. 4 is a perspective view and shows the mounting of the profile of a human portrait or sculpture on a reflective surface such as a mirror.

FIG. 4 shows an arrangement in which the symmetrical half 14 of the three-dimensional object to be viewed is mounted on a reflective or mirror surface 32, and the viewing is carried out without the presence of a transparent block between the reflective surface 32 and the viewer. In this arrangement of FIG. 4, a viewer may receive the light rays originating directly from the impression 14 together with the reflected light rays from the mirror surface 32 so as to see the composite picture and obtain the full view of the bust 14 and not just the profile thereof. The reflective mirror surface 32 may be obtained from a conventional plate-shaped mirror, for example. At the same time, however, the reflective surface may also be obtained by coating a plate surface with reflective paint or silver, for example.

The object to be viewed is not limited to being a portrait, sculpture or bust. The object may also be in the form of jewelry or other articles which may be displayed, for example.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A display device comprising: means having a reflective surface; half of a symmetrical object mounted on said reflective surface, said reflective surface being in the plane of symmetry of said symmetrical object so that when said half of the object is viewed together with reflections of said half from said reflective surface two symmetrical halves of said object may be seen simultaneously; said means having a reflective surface comprises a block of transparent material, said reflective surface being on the backside of said block, said reflective surface being viewed from the front side of said block and through the thickness of said block; said half of said symmetrical object being in direct contact with said block of transparent material so that said contact is free of an air space between half of said object and said block, said block applying refractions to reflections from said half of said object and from said reflective surface so that a predetermined view is obtained dependent on the direction from which said half of said object is viewed; said predetermined view in size and shape being also dependent on the shape of said block of transparent material, said block having a back side and a front side, said back side being inclined at a substantial angle with respect to the front side of said block.

2. A display device as defined in claim 1 wherein said block of transparent material comprises a rectangular-shaped block.

3. A display device as defined in claim 1 wherein said block of transparent material has a semi-cylindrical shape joined by a planar surface, said reflective surface being on said planar surface.

4. A display device as defined in claim 1 wherein said half of the object is cut in said block.

5. A display device as defined in claim 1 wherein said half of the object is embedded in said block.

6. A display device as defined in claim 1 wherein said block is comprised of glass.

7. A display device as defined in claim 1 wherein said block is comprised of plastics.

8. A display method comprising the steps of: inserting into a block of transparent material the surface characteristics of half of a symmetrical object; applying a reflective surface to one side of said block of transparent material, said reflective surface being in the plane of symmetry of said symmetrical object; and viewing said surface characteristics of said half of said symmetrical object in combination with said reflective surface to obtain a view of said half of said object together with the view of the reflections of said half from said reflective surface so that two symmetrical halves of said object may be seen simultaneously; said half of said symmetrical object being in direct contact with said block of transparent material so that said contact is free of an air space between said half of said object and said block, said block applying refractions to reflections from said half of said object and from said reflective surface so that a predetermined view is obtained dependent on the direction from which said half of said object is viewed, said predetermined view in size and shape being also dependent on the shape of said block of transparent material.

* * * * *